US005862984A

United States Patent [19]

Chang

[11] Patent Number: 5,862,984

[45] Date of Patent: Jan. 26, 1999

[54] ORNAMENTAL ARTIFICIAL FOUNTAIN APPARATUS

[76] Inventor: Wen-Hsiang Chang, No. 1, Alley 36, Lane 121, Te-Lin Rd. Lung-Tan Hsiang, T'ao-Yuan Hsien, Taiwan

[21] Appl. No.: 709,157

[22] Filed: Sep. 6, 1996

[30] Foreign Application Priority Data

Aug. 2, 1996 [TW] Taiwan ..... 85211766

[51] Int. Cl.[6] ..... B05B 17/08

[52] U.S. Cl. ..... 239/17; 239/16; 239/18; 239/20

[58] Field of Search ..... 239/16–18, 20

[56] References Cited

U.S. PATENT DOCUMENTS 1,837,732 12/1931 Stabler ..... 239/18

FOREIGN PATENT DOCUMENTS 1047535 10/1983 U.S.S.R. ..... 239/17

1186278 10/1985 U.S.S.R. ..... 239/17

*Primary Examiner*—Lesley D. Morris

*Attorney, Agent, or Firm*—Bacon & Thomas

[57] ABSTRACT

An ornamental artificial fountain apparatus according to the invention includes a water basin, in which a peripherally extending annular water pipe with a plurality of nozzles is provided at a decent level. The inclination angles of nozzles are adjustable. Inside the water basin there is installed a guide pole in which a control mechanism is provided to regulate the water stream flowing through the guide pole and its spreading area. A multiple-port joint connects the pump with the annular water pipe and the guide pole by its two side branch pipes. By means of a cock on the multiple-port joint, the water flow entering the annular water pipe and the guide pole can be tuned at will. Moreover, along with the ascent and descent of a canopy of the guide pole as well as nozzles of assorted inclination angles, the apparatus can generate varying water streams and water curtains.

8 Claims, 7 Drawing Sheets

ORNAMENTAL ARTIFICIAL FOUNTAIN APPARATUS

SUMMARY OF THE INVENTION

The present invention relates to an ornamental artificial fountain apparatus, especially to a fountain apparatus that can generate a central water curtain and a plurality of peripheral water jets with varying water flows. Therefore, the apparatus according to the invention can produce assorted water flow views.

Most of ornamental objects are static and draw people's attention by the aesthetic outer appearances. Such ornamental objects are simpler and lack changes. Hence, it is desirable to have an ornamental apparatus that can produce a dynamic visual effect.

Take the ornamental fountain apparatus shown in FIG. 1 as an illustrative example. It includes a large water basin 11 situated on the top of a base 10. The water basin 11 is provided with an ornamental object 12 on the top thereof, the elegant configuration of which gives the fountain apparatus a fancy appearance. Moreover, to promote a pleasing effect, a typical fountain apparatus comprises a guide structure 13 that directs the water in the water basin 11 to flow along radially extending imitation leave structures 14 so that the ornamental object can exhibit static grace and dynamic animation. However, the dynamic effect of such a conventional apparatus is still insufficient. The water flow generated by the apparatus has not great variability.

In view of the above problems, the main object of the invention is to provide an artificial fountain apparatus in which a water basin is provided with a peripherally extending annual water pipe with a plurality of distantly spaced nozzles that are adjustable in inclination and a guide pole for tuning the flow rate of the water in the guide pole so that the apparatus can generate a vivid and magnificent view, promoting the ornamental effect.

Another object of the invention is to provide an artificial fountain apparatus in which a multiple-port joint is disposed at the outlet of a pump and a cock is arranged on the joint. The ratio between the water flow in the nozzles and the guide pole can be tuned by means of the rotation of the cock. As a consequence, such an alteration of flow ratio can enhance the diversification of water flows of the artificial fountain, in conjunction with the variation in the inclination of nozzles and spreading areas of water curtains.

Further features and advantages of the invention will now be described in detail with reference to a preferred embodiment illustrated in the accompanying drawings.

BRIEF DESCRIPTION OF ACCOMPANYING DRAWINGS

FIG. 1 schematically shows a prior art ornamental fountain apparatus.

FIG. 2 perspectively shows an artificial fountain apparatus constructed according to the invention.

Figure 1:
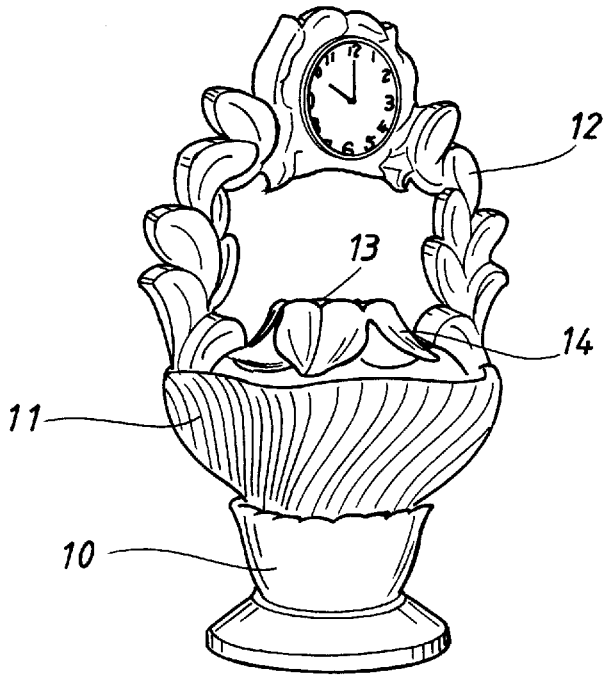
FIG. 1 PRIOR ART
Figure 2:
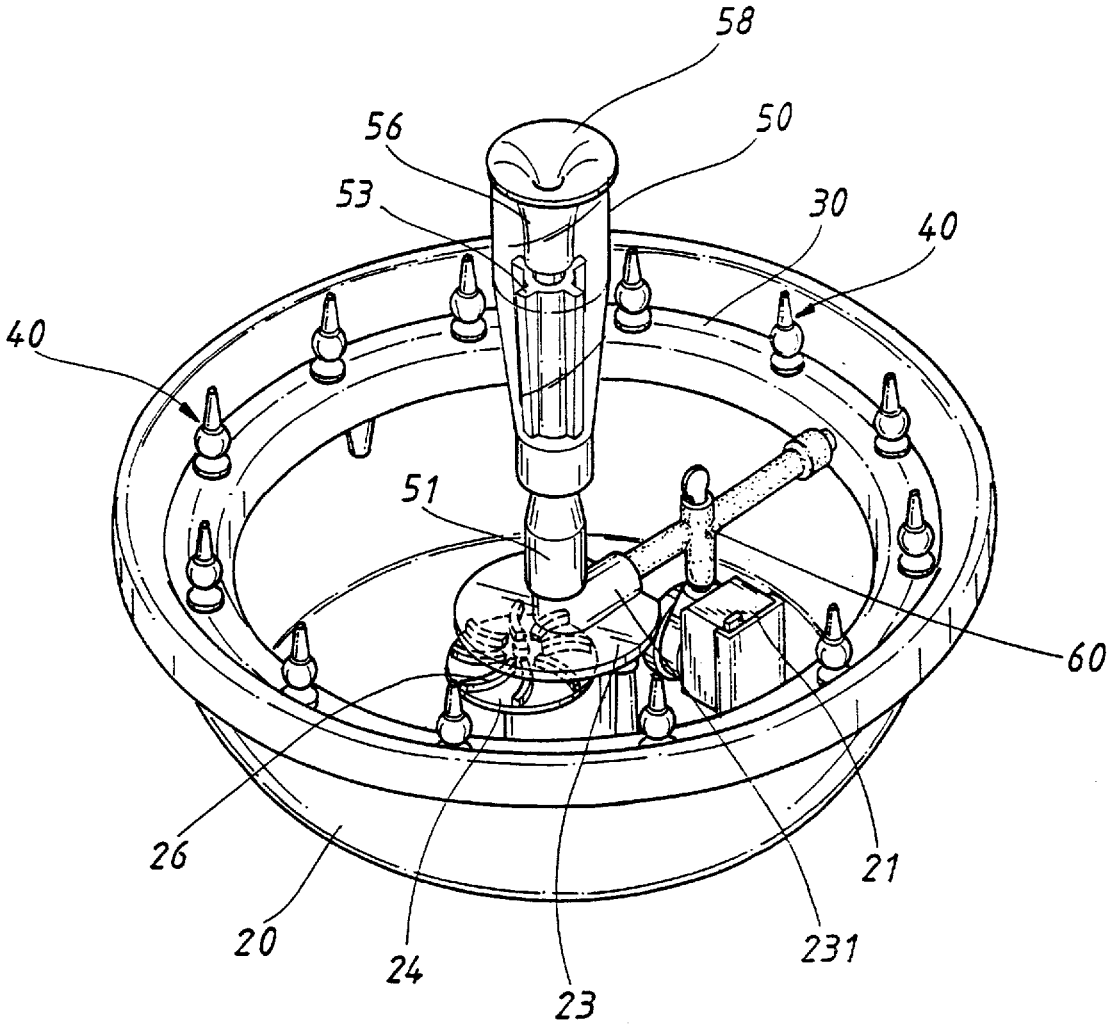
Figure 7:
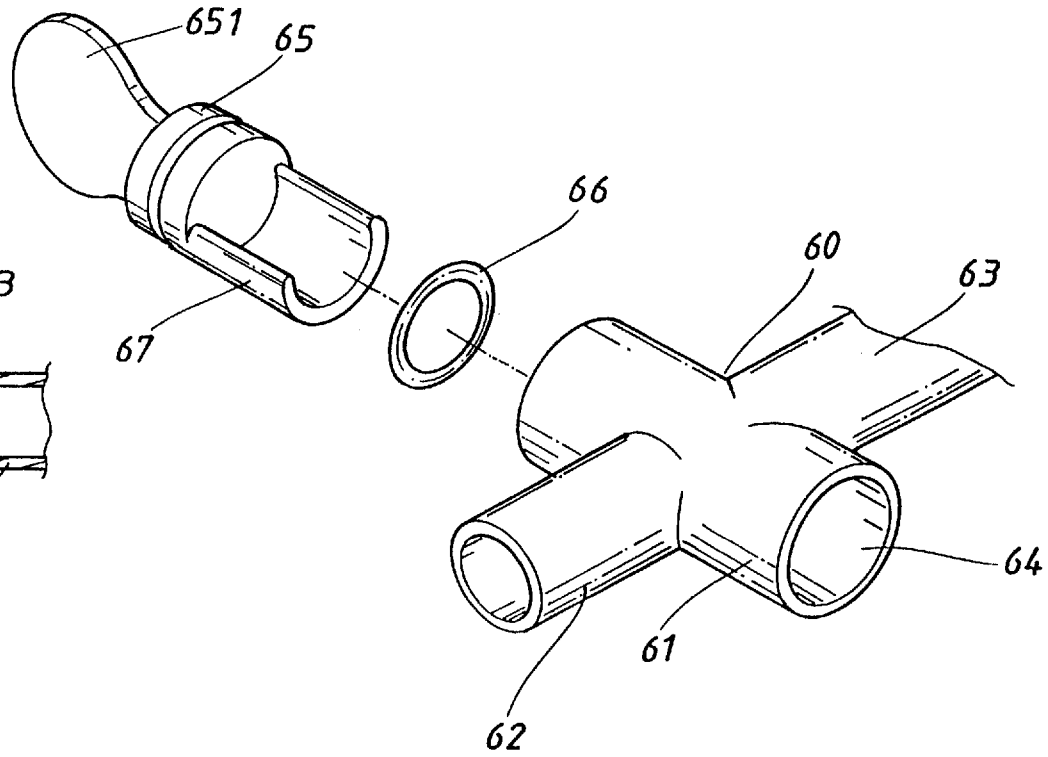

FIG. 7 explosively shows the multiple-port joint used in the apparatus of FIG. 2 and its adjusting cock.

Figure 8:
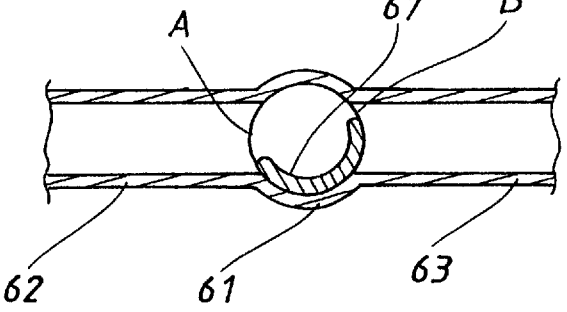

FIG. 8 is a partial sectional view of the joint of FIG. 7.

DETAILED DESCRIPTION OF A PREFERRED EMBODIMENT

Referring to FIG. 2, an ornamental artificial fountain apparatus according to the invention includes a water basin 20 of a decent size. The water basin 20 is provided at a suitable level with a peripheral annual water pipe 30 with a plurality of nozzles 40 equidistantly spaced. Inside the apparatus there is installed at the center of the bottom of the water basin 20 an upright guide pole 50 through which a water curtain around the guide pole is created. The interior of the water basin 20 further comprises a pump 21 below the annular water pipe 30 for supplying pressured water flow to the annular water pipe 30 and the guide pole 50 via a multiple-port joint 60.

Figure 3:
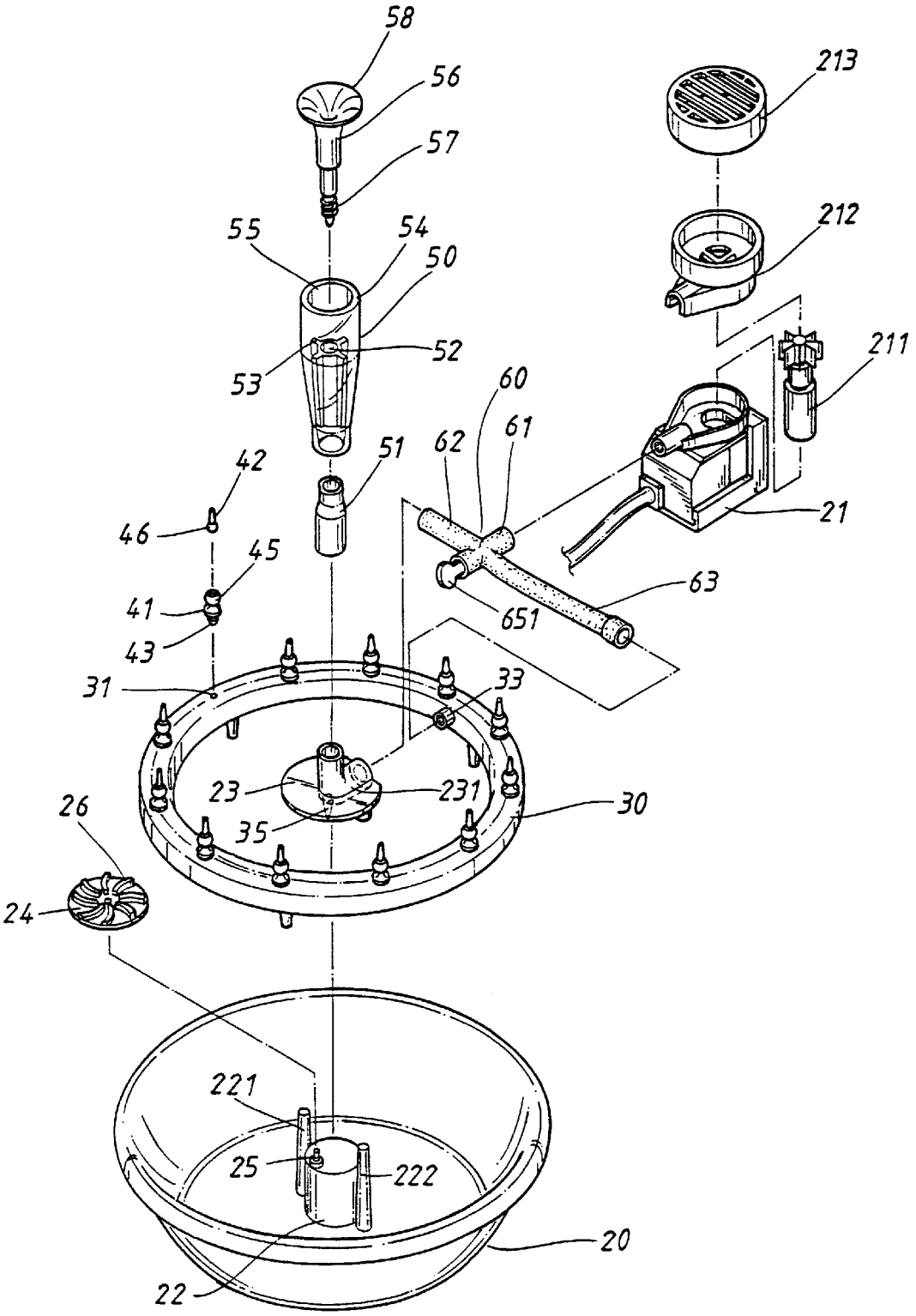
FIG. 3 is an exploded view of the apparatus of FIG. 2.

As can be best seen from FIG. 3, the water basin 20 has a central mounting block 22 and two locating posts 221 and 222 for supporting a circular disk 23. The disk 23 is provided with an elbow bend 231 for joining the guide pole 50 with the multiple-port joint 60. Illuminating apparatuses (not shown in the drawings) may be arranged in the rest space in the interior of the water basin. A transparent colored disk 24 is pivotally connected to the mounting block 22 by means of a shaft 25 on the top surface of the mounting block 22 extending into the center hole of the colored disk 24. The colored disk 24 has a plurality of spiral ribs 26 formed on the top surface thereof. The guide pole 50 is connected to one end of the elbow bend 231 of the circular disk 23 via a connection tube 51.

Figure 5:
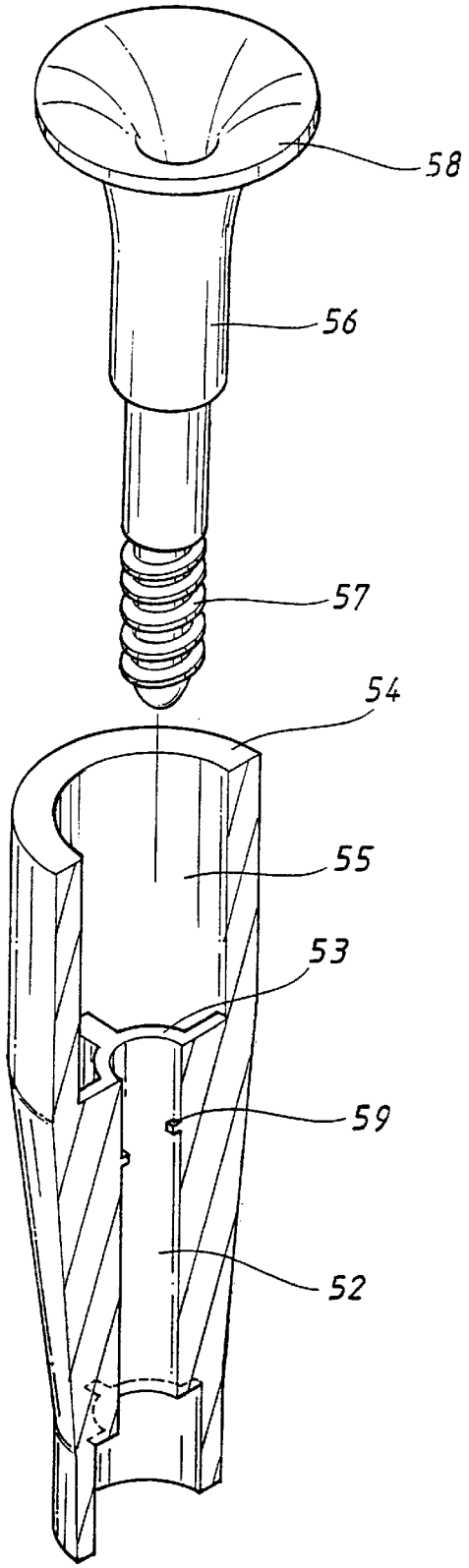
FIG. 5 is an enlarged and exploded view of the central water guide pole employed in the apparatus of FIG. 2.

Now referring to FIG. 5, the guide pole 50 is generally provided with a central hole 52 extending to the bottom thereof. The top end 53 of the central hole 52 is at a distance below the top surface 54 of the pole 50. An enlarged hole 55 is formed beyond the top of the hole 52. An adjusting element 56 is configured to have a body of a diameter smaller than the diameter of the enlarged hole 55 and has a certain length of lower end threaded portion 57 as well as a curved canopy 58 having a diameter slightly larger than that of the enlarger hole 55. By means of the lower end threaded portion 57 working in cooperation with a guide lug 59 formed on the inner wall surface of the central hole 52, the adjusting element 56 can rise or descend. With this arrangement the gap between the curved canopy 58 and the top surface 54 of the pole 50 can be adjusted to form assorted water curtains covering various areas.

Figure 6:
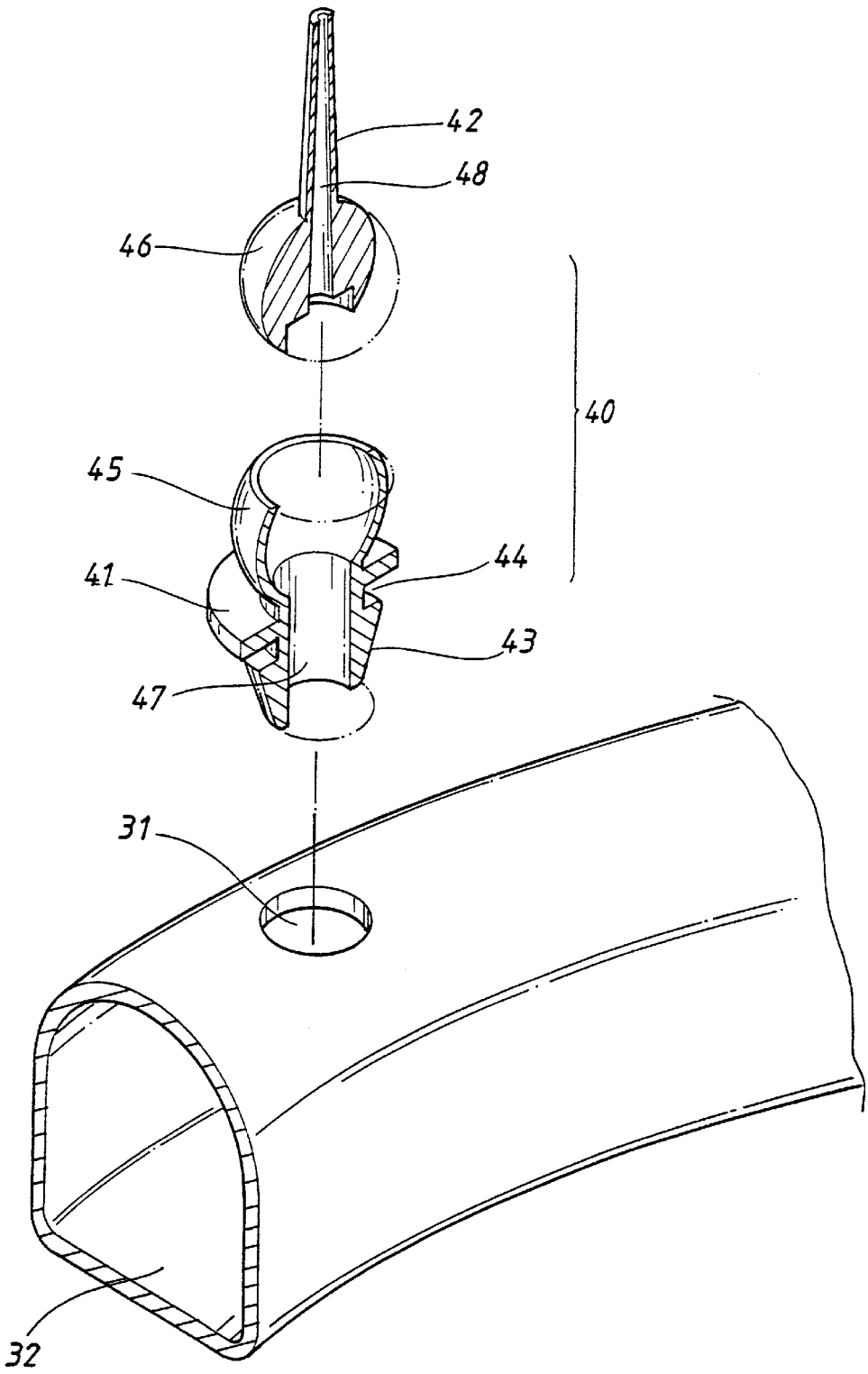
FIG. 6 shows a nozzle of the apparatus of FIG. 2 in an exploded manner.

As shown in FIG. 6, each nozzle 40 consists of an engaging base 41 and a nozzle tube 42. The engaging base 41 comprises a hollow conical portion 43 extending downwardly and an annular groove 44 formed on the root of the conical portion 43. A spherical socket 45 is provided on the top of the engaging base 41 for pivotally joining a spherical end portion 46 of the nozzle 42 so that the nozzle 42 in the socket 45 can rotate around the central axis of the nozzle tube 42 to an arbitrary orientation. The nozzle 40 can be mounted on the annular water pipe 30 by means of the insertion of the conical portion 43 into openings 31 disposed on the pipe wall of the water pipe 30 in such a way that the annular groove 44 firmly engages with the wall of the water pipe 30 to form a channel allowing water in the interior 32 of the annular water pipe 30 rushes out through the central hole 47 of the engaging base 44 and the central hole 48 of the nozzle tube 42.

In a preferred embodiment shown in FIG. 7, a multiple port joint 60 is provided with a central pipe 61. The central pipe 61 is further connected to a pump 21 that consists of a rotatable member 211, a cap 212, and a top cover 213. Through two side branch pipes 62 and 63 respectively, the central pipe 61 communicates with the elbow bend 231 under the water guide pole 50 and a pipe joint 33 of the annular water pipe 30 as shown in FIG. 3. Furthermore, the inner water channel 64 of the central pipe 61 connects with a water outlet of the pump 21 at one end and is provided at the other end with a cock 65 with an O-ring 66 sealing the junction therebetween. The cock 65 has a flat tab 651 at one end by which the cock 65 can be rotated to various orientations and an extended semi-circular thin wall 67 at the other end, which extends into the inner water channel 64 of the central pipe 61 and is transversely interposed between the side branch pipes 62 and 63 so that the openings A and B of the side branch pipes 62 and 63 (shown in FIG. 8) can be partially opened or closed by adjusting the orientation of the cock 65. As shown in the illustration, when the opening A of the branch pipe 62 is larger than the open B of another branch pipe 63 the water flow from the pipe 62 to the water guide pole 50 is smaller than that from the pipe 63 to the annular water pipe 30. To the contrary, when the width of the opening A is adjusted by the cock 65 to a smaller size, the opening B becomes larger and then the water flow in the guide pole 50 is smaller than that in the annular water pipe 30.

Figure 4:
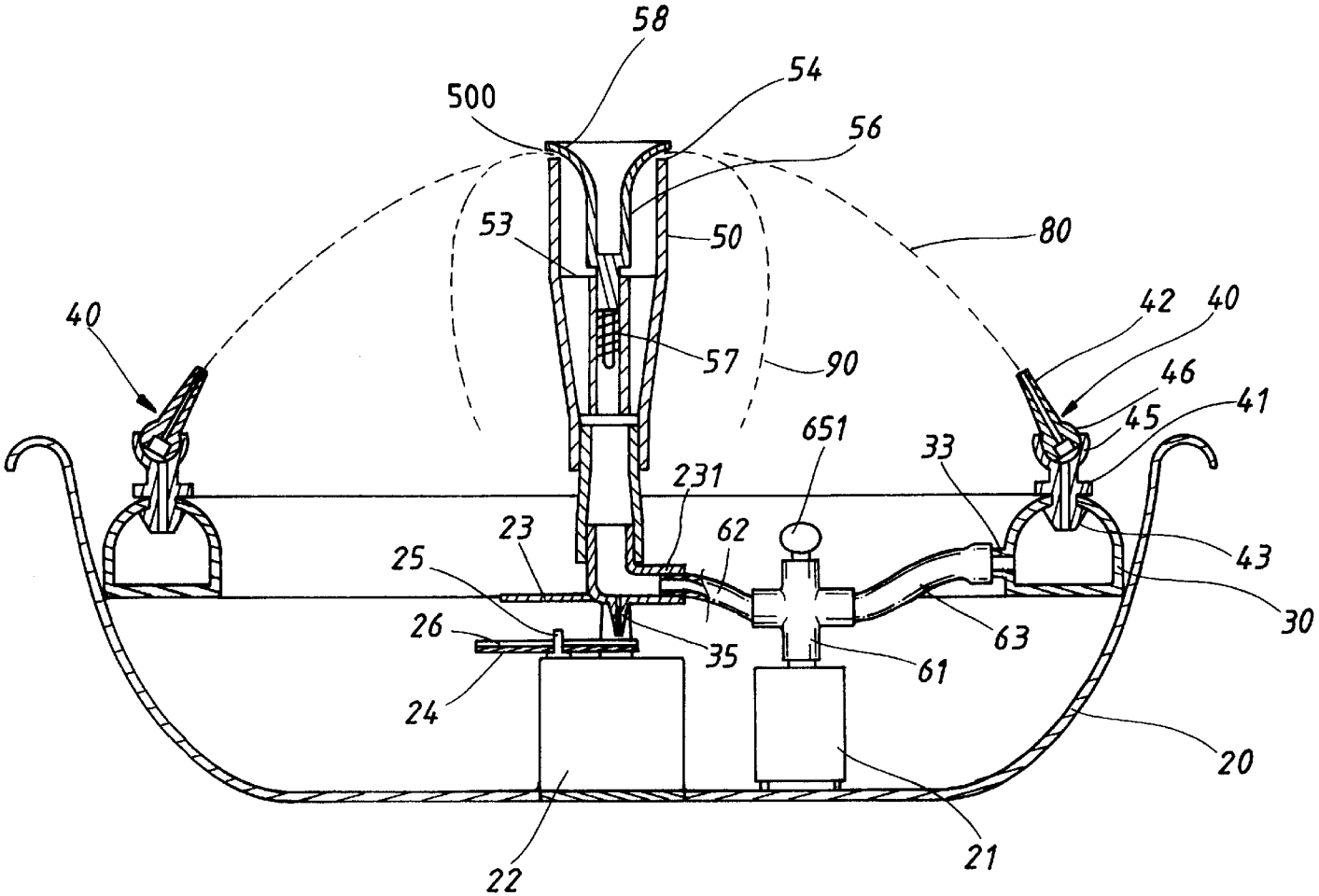
FIG. 4 is a cross-sectional view of the apparatus of FIG. 2.

As shown in FIG. 4, the circular disk 23 situated above the colored disk 24 can preferably be provided with a water tube 35 downwardly extending to the disk 24 and having a water outlet facing toward the ribs 26 on the surface of the disk 24 so that the water flowing out of the outlet can move the colored disk 24 to rotate.

As shown in FIGS. 2 and 4, when the pump starts the pressured water flows through the multiple-port joint and then enters the annular water pipe 30 and the guide pole 50 respectively in proportion to the sizes of the openings A and B. The water in the annular water pipe 30 is directed by the nozzles 40 to form fine streams 80 in a preset angle, while the water in the guide pole 50 flows through the gap 500 between the curved canopy 58 of the adjusting element 56 and the top surface 54 of the guide pole 50 and pours down to form a water curtain which can has a spread of varying distances along with the variation of the gap 500. Except that the tube 42 of nozzles 40 and the adjusting element 56 of the guide pole 50 can be individually set in varying directions to form streams 80 and a water curtain 90 in different angles and of different flow rates, the cock 65 of the multiple-port joint 60 also governs the ratio of flow rate of two side branch pipes to provide various water flow views.

Further, the illumination in the water basin 20 and the continuously rotating colored disk 24 can wake the ornamental apparatus more brilliant and splendid.

Obviously the apparatus according to the invention can produce water flows in various angles and along different water jet paths so it indeed enhances the ornamental effect of an artificial fountain apparatus.

What is claimed is:

1. An artificial fountain apparatus, at least comprising:

a water basin that has a decent amount of volume and inside which a pump is disposed;

an annual water pipe arranged in said water basin at a suitable level and having many distantly spaced nozzles formed thereon;

a guide pole installed on a central mounting block of said water basin, said guide pole consisting of a body with a central hole and an adjusting element having a curved canopy and engageable with said body so that the gap between the canopy and the top surface of the pole body is adjustable by the adjusting element to set the spreading distance of produced water curtains; and a multiple-port joint having a central pipe connected to said pump and two side branch pipes separately arranged on two sides of said central pipe and individually connected to an elbow bend under said guide pole and a pipe joint of said annular water pipe.

2. An artificial fountain apparatus as claimed in claim 1, wherein each of the nozzles is composed of an engaging base and a nozzle tube, said engaging base having a hollow conical portion extending downwardly with an annular groove formed on the root of the conical portion and a spherical socket provided on the top surface of said engaging base for pivotally joining a spherical end portion of the nozzle.

3. An artificial fountain apparatus as claimed in claim 1, wherein said multiple-port joint is further provided with a cock on one end of said central pipe, said cock being configured to have a semi-circular thin wall extending into the central pipe and transversely disposed between two side branch pipes for adjusting the ratio of the water flows in two branch pipes.

4. An artificial fountain apparatus as claimed in claim 1, wherein the adjusting element of the guide pole has a threaded lower end portion that works in cooperation with a guide lug formed on the inner wall surface of the central hole of the guide pole to regulate the level of the adjusting element.

5. An artificial fountain apparatus as claimed in claim 1, wherein said guide pole is connected to a circular disk on the mounting block via a connecting tube, said circular disk having an elbow bend provided on the top thereof for connecting with the multiple-port joint.

6. An artificial fountain apparatus as claimed in claim 1, wherein the guide pole has another enlarged hole provided above said central hole thereof to form an enlarged space, said canopy of the adjusting element being larger in diameter than the enlarged hole and a gap being defined by means of the canopy and the top surface of the enlarged hole.

7. An artificial fountain apparatus as claimed in claim 1, wherein the central mounting block of the water basin is further provided with a shaft on the top thereof for rotatably mounting a colored disk.

8. An artificial fountain apparatus as claimed in claim 7, wherein the colored disk is provided with a plurality of ribs on the top surface thereof that can be moved by water flow from a pipe extending from the bottom surface of the circular disk.

* * * * *